US006415946B2

(12) United States Patent
Carlo et al.

(10) Patent No.: US 6,415,946 B2
(45) Date of Patent: Jul. 9, 2002

(54) PRESSURE VESSEL HEAD RING ASSEMBLY

(75) Inventors: Charles C. Carlo, Humble, TX (US); Stephen H. Mauldin, Charlotte, NC (US)

(73) Assignee: Aviation Mobility, LLC, Charlotte, NC (US)

( * ) Notice: Subject to any disclaimer, the term of this patent is extended or adjusted under 35 U.S.C. 154(b) by 0 days.

(21) Appl. No.: 09/747,736

(22) Filed: Dec. 22, 2000

Related U.S. Application Data

(60) Provisional application No. 60/196,358, filed on Apr. 12, 2000.

(51) Int. Cl.[7] ..... B65D 25/20

(52) U.S. Cl. ..... 220/724

(58) Field of Search ..... 137/382; 220/724–728

(56) References Cited

U.S. PATENT DOCUMENTS

| | | | | | |
|---|---|---|---|---|---|
| 2,339,930 | A | | 1/1944 | Howick | 220/85 |
| 3,958,716 | A | | 5/1976 | Korte | 220/85 P |
| 4,103,806 | A | | 8/1978 | White | 222/3 |
| 4,109,692 | A | | 8/1978 | Brown | 150/52 R |
| 4,215,581 | A | | 8/1980 | Bolick et al. | 73/431 |
| 4,352,370 | A | | 10/1982 | Childress | 137/382 |
| 4,389,890 | A | | 6/1983 | Bolick et al. | 73/431 |
| 4,420,013 | A | | 12/1983 | DiBlasio | 137/382 |
| 4,600,033 | A | | 7/1986 | Baron | 137/382 |
| 5,058,758 | A | | 10/1991 | Suddeth | 220/85 P |
| 5,071,148 | A | * | 12/1991 | Salvucci, Sr. | 137/382 |
| 5,253,760 | A | * | 10/1993 | Miller | 206/525 |
| 5,429,152 | A | | 7/1995 | Van Straaten et al. | 137/377 |
| 5,638,858 | A | * | 6/1997 | Gettinger et al. | 137/382 |
| 6,041,812 | A | * | 3/2000 | Hilbers | 137/377 |

OTHER PUBLICATIONS

Reference A, Prior Art Device—Figure, Apr. 11, 1999 (1 yr. prior to filling of related provisional application).
Reference B1–B3, Prior Art Device—Photographs, Apr. 11, 1999 (1 yr. prior to filling of related provisional application).

* cited by examiner

*Primary Examiner*—Stephen Castellano
(74) *Attorney, Agent, or Firm*—Kilpatrick Stockton LLP; Charles W. Calkins; Christopher L. Bernard

(57) ABSTRACT

A head ring protects the valving assembly, or regulator, flow adjuster, and content gauge, commonly attached to a pressure vessel, such as a conventional pressurized gas cylinder. The head ring includes a base securable to the dispensing end of the pressure vessel. A plurality of posts are distributed about a perimeter of the base, each of the posts extending vertically upward from about the base to beyond the valving assembly. Each of the posts has a first end and a second end. A collar is secured to a portion of the perimeter of the base, and the collar extends vertically downward from the perimeter of the base. The collar includes a radially-extending flange at each end. A first ring horizontally extends from the posts and is secured adjacent to the first end of the posts. A second ring horizontally extends from the posts and is secured adjacent to the second end of the posts. The first ring and the second ring are radially positioned outward of the regulator, the flow adjuster and the content gauge. A gauge protection plate extends vertically downward from the first ring. The gauge protection plate includes an interior wall defining a plate opening. The plate opening is sized to allow visual access to the content gauge. The head ring protects the valving assembly during handling and transport of the pressure vessel. The head ring assembly may also act as part of a pressure vessel assembly or a package assembly, the package assembly including an outer pack made from a durable material defining a bag sized to surround and protect the pressure vessel.

17 Claims, 10 Drawing Sheets

PRESSURE VESSEL HEAD RING ASSEMBLY

CROSS-REFERENCE TO RELATED APPLICATIONS

This application claims the benefit of U.S. Provisional Application No. 60/196,358, filed Apr. 12, 2000.

BACKGROUND OF THE INVENTION

1. Field of the Invention

This invention relates generally to pressure vessels, such as pressurized gas canisters and compressed gas cylinders, and, more particularly, to a head ring assembly for protecting the valving of pressure vessels.

2. Description of the Related Art

The Air Transport Association ("ATA") and the International Air Transport Association ("IATA") have recently released specifications affecting the design of airline shipping containers. Specifications ATA-300 and IATA-200 establish the airline industry's standards for acceptable packaging of shipping containers used in air transport and address such issues as proper packaging design, marking, and inspection/testing. These specifications ensure that materials, such as pressurized cylinders containing oxygen and other fluids, are adequately protected during handling and transport. For example, these specifications require that gas cylinders have valve protection head rings to protect the valves from damage or inadvertent opening during transport. Further requirements ensure the integrity of packaging and valving after repeated exposure to extreme temperatures, harsh chemicals, and vibration. Thus, these specifications ensure the safe handling and transport of compressed fluids and other materials.

At least one head ring design has previously been used to protect the valving associated with a pressure vessel. This previous head ring was designed to protect the regulator, flow adjuster, and content gauge during handling and transport of the pressure vessel. The design has spaced-apart concentric rings that surround the valving, protecting the valving. Aviation Mobility, for example, manufactured such a head ring (Aviation Mobility, a division of Access Management Group, 201 South Tryon Street, Suite 1210, Charlotte, N.C. 28202, tel. 704-525-7005, www.accessmg.com).

Previous head ring designs, however, often incurred damage in the field. While previous head ring designs protected the valving to some extent, the head ring itself often deformed from normal use. Welds, for example, failed from impacts. Rings were damaged because of these failed welds. These weld failures shortened the expected life of each head ring and created premature repair costs.

Other problems with these previous head ring designs involved the fastening mechanism. Prior head rings used a clamping system to attach the head ring to the pressurized cylinder. A U-bolt, for example, clamped the head ring to the cylinder. This U-bolt clamping system, however, could not maintain proper orientation between the head ring and the valving. The U-bolt clamp permits the head ring to rotate and expose the valving. The U-bolt clamp also has exposed threads, and these exposed threads were easily damaged during handling. These damaged threads make the U-bolt difficult to remove. The U-bolt clamping system is also labor intensive and requires an intricate field operation.

Prior head ring designs also had compatibility problems. While there are two leading manufacturers of light-weight gas cylinders, there are slight dimensional differences between each manufacturer's cylinder design. These dimensional differences are acute in the neck region of the cylinder. Previous head ring designs were not compatible with both manufacturers. One head ring design was required for one manufacturer, while another head ring design was required for the other manufacturer. This compatibility problem increased the cost of the head ring and created confusion and mismatch.

There is, accordingly, a need in the art for a head ring design that is robust, a head ring design that is easily attached and properly oriented to a gas cylinder, a head ring design that is compatible with multiple cylinder configurations, and a head ring design that is always cost effective.

BRIEF SUMMARY OF THE INVENTION

The aforementioned problems are minimized by the present invention. A head ring protects the valving assembly, or regulator, flow adjuster, and content gauge, commonly attached to pressure vessels, such as conventional pressurized gas cylinders. The head ring includes a base securable to the dispensing end of the pressure vessel. A plurality of posts are distributed about a perimeter of the base, each of the posts extending vertically upward from about the base to beyond the valving assembly. Each of the posts has a first end and a second end. A collar is secured to a portion of the perimeter of the base, and the collar extends vertically downward from the perimeter of the base. The collar includes a radially-extending flange at each end. A first ring horizontally extends from the posts and is secured adjacent to the first end of the posts. A second ring horizontally extends from the posts and is secured adjacent to the second end of the posts. The first ring and the second ring are radially positioned outward of the regulator, the flow adjuster, and the content gauge. A gauge protection plate extends vertically downward from the first ring. The gauge protection plate includes an interior wall defining a plate opening. The plate opening is sized to allow visual access to the content gauge. The head ring protects the valving assembly during handling and transport of the pressure vessel. The head ring assembly may also comprise part of a pressure vessel assembly or a package assembly for protecting the pressure vessel, the package assembly including an outer pack made from a durable material defining a bag sized to surround the pressure vessel.

BRIEF DESCRIPTION OF THE DRAWINGS

These and other features, aspects, and advantages of the present invention will be better understood when the following Detailed Description of the Invention is read with reference to the accompanying drawings, wherein.

DETAILED DESCRIPTION OF THE INVENTION

Figure 1:
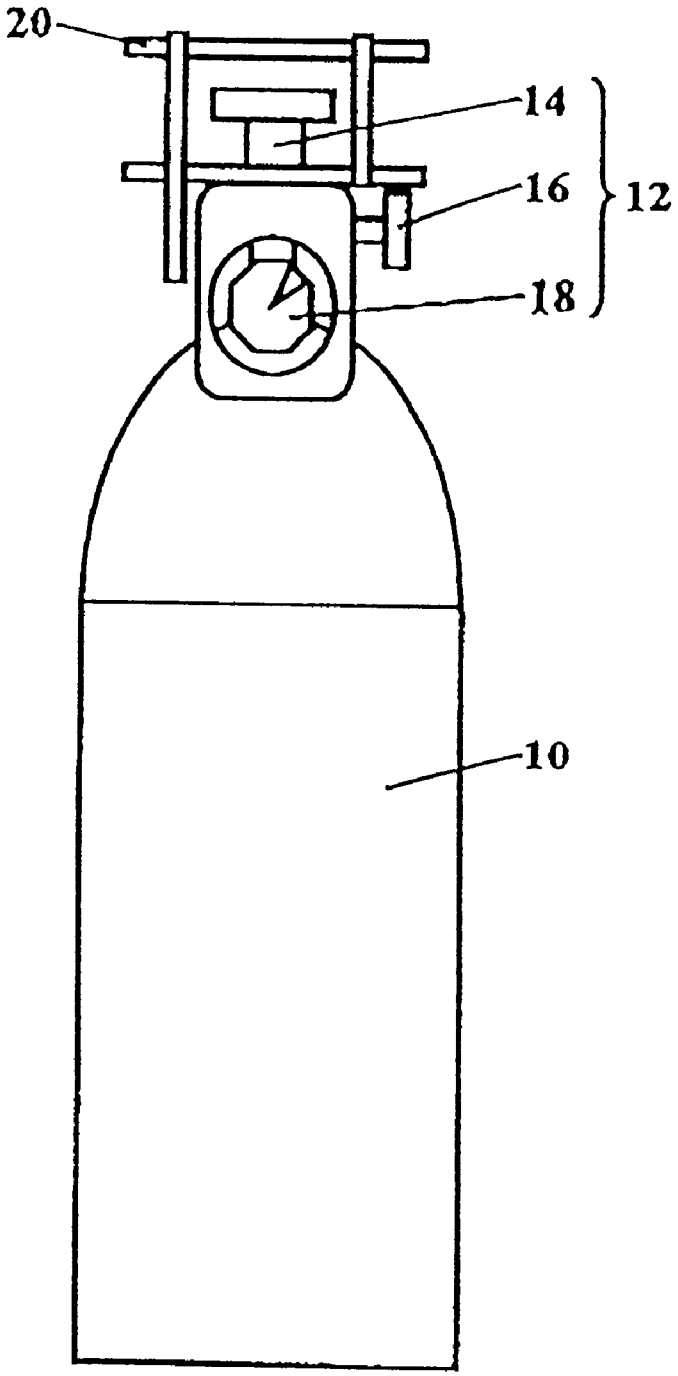
FIG. 1 is a side view of a pressure vessel and valving assembly incorporating a head ring assembly.

FIG. 1 is a side view of a pressure vessel 10 and valving assembly 12. As those skilled in the art recognize, the valving assembly 12 commonly includes a regulator 14, a flow adjuster 16, and a content gauge 18. A head ring 20 of the present invention protects the valving assembly 12 from damage during handling and transport.

The pressure vessel 10 is shown as a common pressurized cylinder. This pressurized cylinder is typically used to store pressurized oxygen, nitrogen, or other gaseous/liquid fluids. Those skilled and unskilled in the art recognize that pressure vessels are available in many different configurations and in many different sizes. Pressure vessels, for example, may include small propane bottles commonly used in camping equipment. Pressure vessels may also include large underground storage tanks. The head ring 20 of the present invention is adaptable to protect the valving assembly 12 of any size or configuration of pressure vessel.

Figure 2:
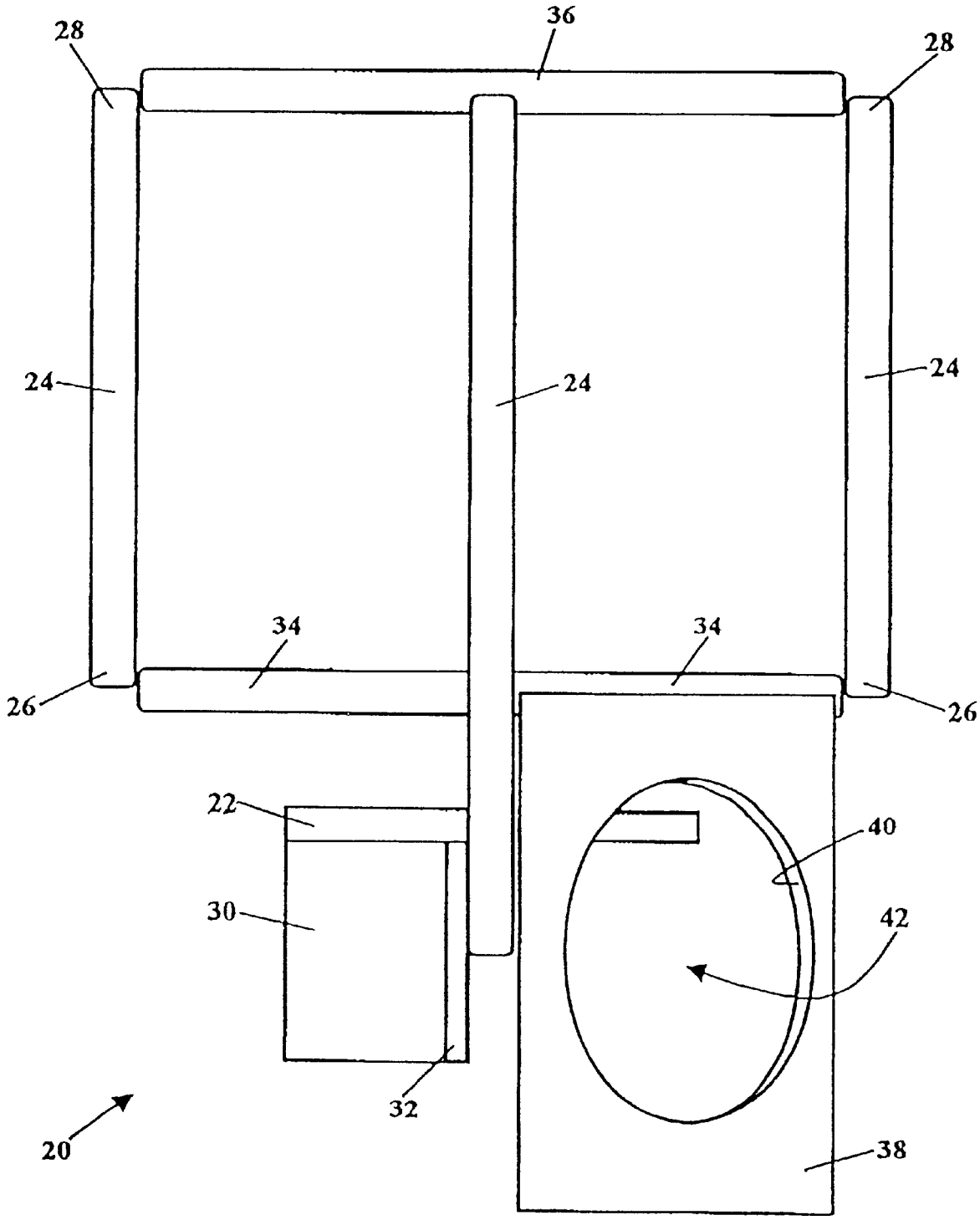
FIG. 2 is a side view of the head ring assembly shown in FIG. 1.

FIG. 2 is a side view of the head ring 20 shown in FIG. 1. The head ring 20 includes a base 22. The base 22 is secured to the pressure vessel 10 (FIG. 1) by the regulator 14 (FIG. 1). A plurality of posts 24 are distributed about a perimeter of the base 22, and each of the posts extends vertically upward from approximately adjacent to the base 22 to beyond the regulator 14 (FIG. 1). Each of the posts 24 has a first end 26 and a second end 28. Each of the posts 24 has a height in the range of about 3 inches to about 7 inches, preferably in the range of about 4 inches to about 6 inches.

The head ring 20 includes a collar 30. The collar 30 is secured to a portion of the perimeter of the base 22 and extends vertically downward from the perimeter of the base 22. The collar 30, in one embodiment, includes a radially-extending flange 32 at each end of the collar 30. The collar 30 mates with the neck and/or shoulder portion of the pressure vessel 10 (FIG. 1) to provide additional stability to the head ring 20. The non-flange portion of the collar 30 may be curved, ranging from a small arc to a semi-circle to a full circle. The flanges 32 may be separately secured or integrally formed with the non-flange portion of the collar 30. Two or more flanges may be separately secured to the non-flange portion of the collar 30 and to other head ring 20 components. Additionally, one or more posts 24 may be secured to the non-flange portion of the collar 30.

The head ring 20 also includes at least a first ring 34 and a second ring 36. The first ring 34 horizontally extends to interconnect the posts 24 and is secured adjacent to the first end 26 of the posts 24. The second ring 36 horizontally extends to interconnect the posts 24 and is secured adjacent to the second end 28 of the posts 24. The first ring 34 and the second ring 36 are radially positioned outward of the flow adjuster 16 (FIG. 1) and the content gauge 18 (FIG. 1) so that if the pressure vessel 10 (FIG. 1), with the head ring 20 attached, is dropped, the rings 34 and 36 protect the valving assembly 12 (FIG. 1) from damage. Additional rings may be added between the first ring 34 and second ring 36 to increase the sturdiness of the head ring 20.

The head ring 20 also includes a gauge protection plate 38 having a thickness and area sufficient to protect the content gauge 18 from damage. The gauge protection plate 38 extends vertically downward from the first ring 34 adjacent the content gauge 18 (FIG. 1) of the valve assembly 12 (FIG. 1). The gauge protection plate 38 includes an interior wall 40. The interior wall defines a plate opening 42. The plate opening 42 is sized to allow visual access to the content gauge 18 (FIG. 1), while the gauge protection plate 38 has an area sufficiently larger than the content gauge 18 to protect the content gauge 18 and to allow the plate to be secured to at least one post and/or the first ring 34.

In effect, the head ring 20 is supported on the pressure vessel 10 by the base 22 and the collar 30. The first or lower end 26 of at least two opposing posts 24 are respectively secured to the opposing flanges 32 of the collar 30. For example, the first ends of each of the posts may be turned radially inward to aid in securing each post to the respective flange. The first, or lower ring 34, and the second, or upper ring 36, are respectively secured in a spaced apart relationship to each of the opposing posts 24. The remaining opposing posts 24 are secured between the lower ring 34 and the upper ring 36. Additionally, the gauge protection plate 38 is secured at its top portion to the lower ring 34, and at one side portion to the lower end 26 of one of the opposing posts 24 that are secured to the collar flange 32. Preferably, all of the components are secured by welding sufficient to withstand the forces of a dropped or toppled pressure vessel 10 (FIG. 1). Preferably three (3), and more preferably four (4), posts 24 are spaced equally about the perimeter of the rings 34 and 36 to minimize or eliminate denting or deflection of the rings or other members caused by mishandling of the pressure vessel 10 (FIG. 1). The components of the head ring 20 are preferably secured to each other through welding, although other attachment methods such as mechanical securing, gluing, or integral forming may be utilized.

Figure 3:
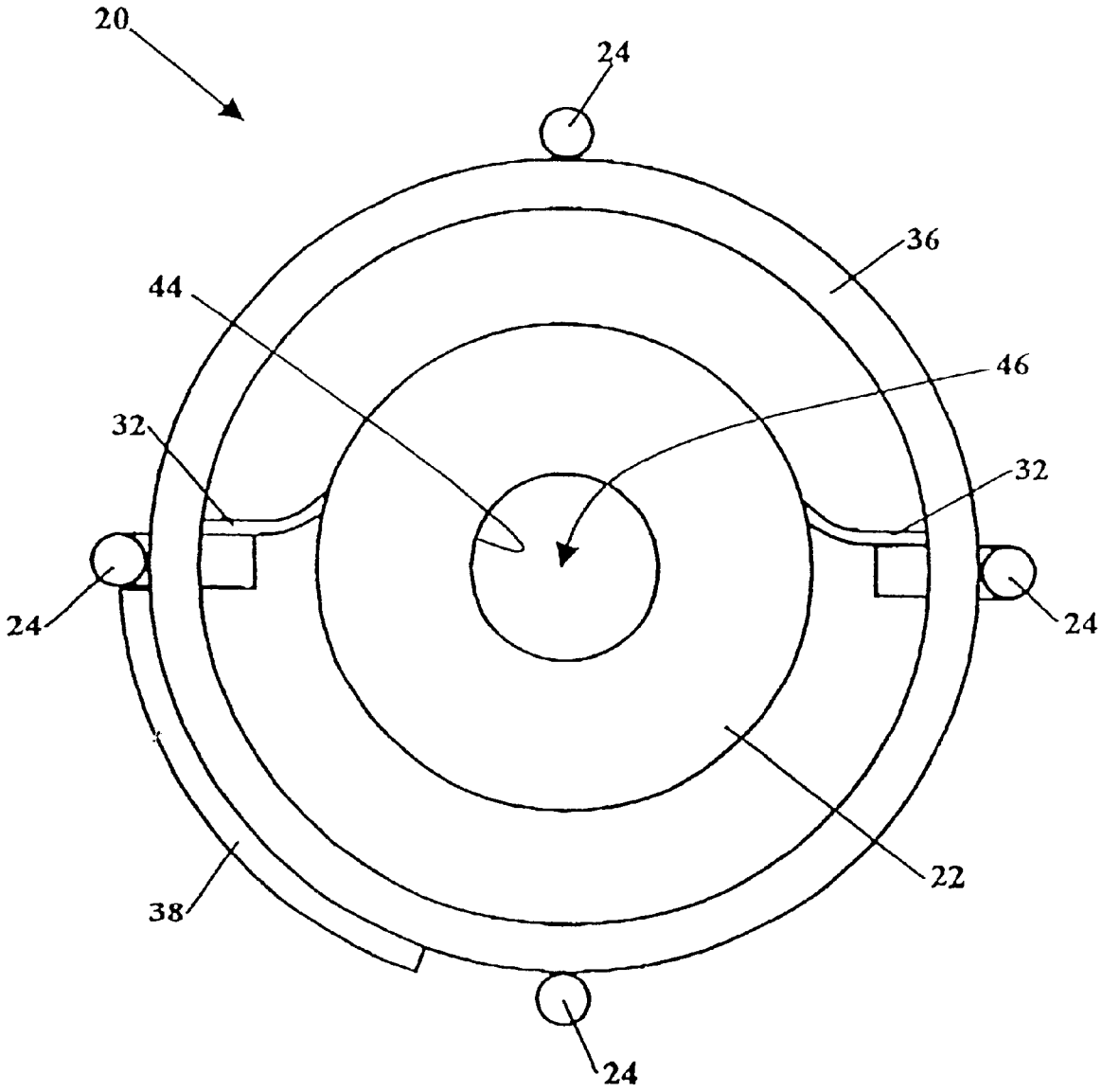
FIG. 3 is a top view of the head ring assembly shown in FIGS. 1 and 2.

FIG. 3 is a top view of the head ring 20 shown in FIGS. 1 and 2. The base 22, which is a washer-like component, also includes an interior wall 44. The interior wall 44 defines a base opening 46. The base opening 46 is sized to allow a threaded portion of the flow adjuster 16 (FIG. 1) to pass through the base opening 46. The regulator 14 (FIG. 1) is then threaded onto the flow adjuster 16 (FIG. 1) to secure the head ring 20. For example, the base opening 46 has a sufficient minimum diameter to fit over a variety of different-sized flow adjusters 16 while having a sufficient maximum diameter to be clamped in place between the regulator 14 and the threaded flow adjuster 16. A means for sealing the head ring 22 to the flow adjuster 16 (FIG. 1) and to the regulator 14 (FIG. 1) may also be provided. The means for sealing the head ring 22 may include, for example, an O-ring between the head ring 22 and the regulator 14 (FIG. 1) or flow adjuster 16 (FIG. 1). The means for sealing the head ring 22 may alternatively include polytetrafluoroethylene (e.g., TEFLON® material as marketed and sold by E. I. du Pont de Nemours and Company) washers between the head ring 22 and the regulator 14 (FIG. 1) or flow adjuster 16 (FIG. 1). Those skilled in the art will readily recognize that various other sealing methods and devices may be used. The means for sealing the head ring 22 may, for example, utilize sealing compounds such as silicone, rubber, or other polymeric materials. A permanent sealant, such as a weld, is also equivalent.

Figure 4:
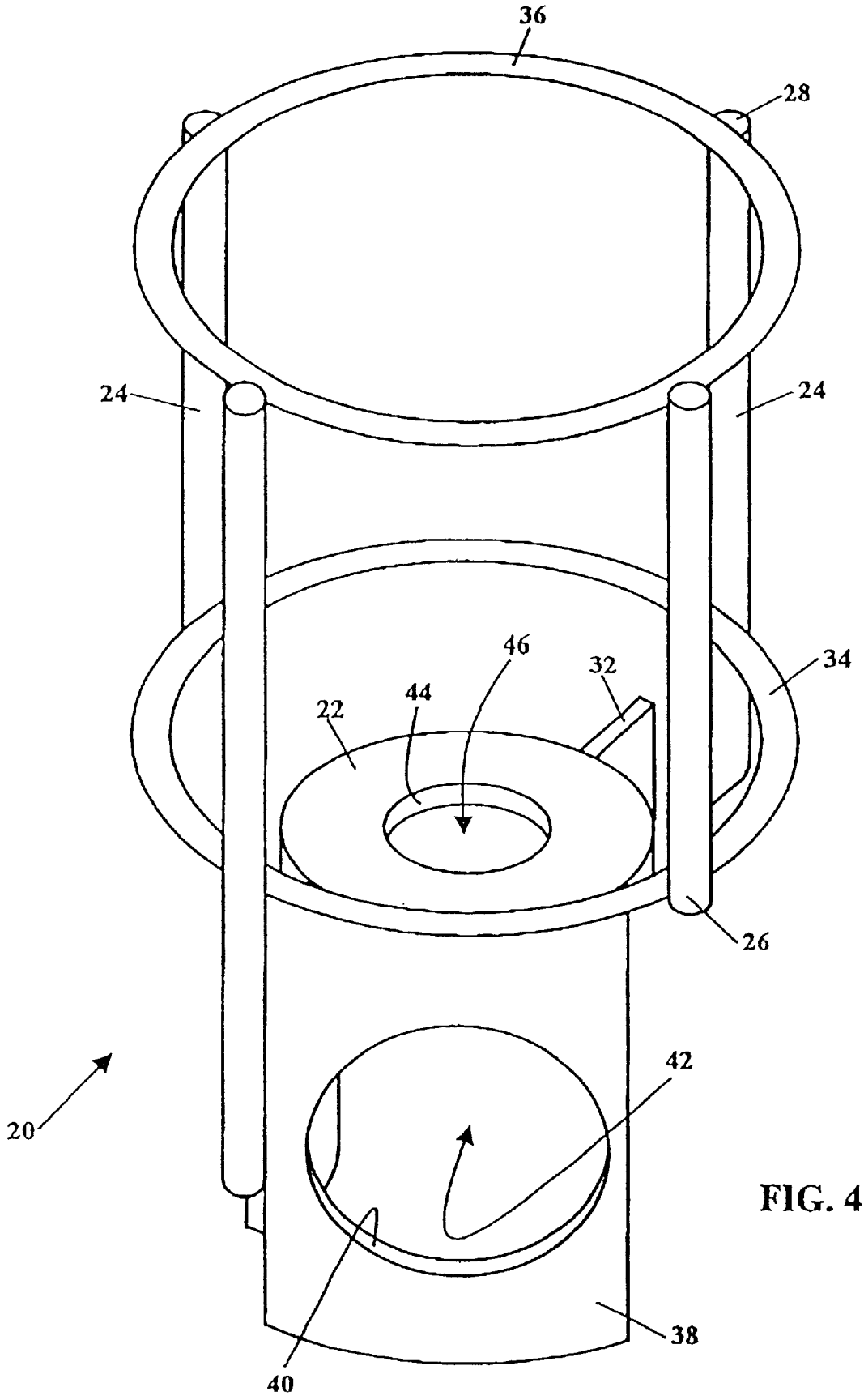
FIG. 4 is a perspective view of the head ring assembly shown in FIGS. 1–3.

FIG. 4 is perspective view of the head ring 20 shown in FIGS. 1–3. The preferred embodiment shown in FIGS. 1–4 has a collar 30 sized to fit various pressure vessels. LUXFER® pressure vessels, for example, are one manufactured type of light-weight aluminum pressure vessels (LUXFER® is a registered trademark of Luxfer Gas Cylinders, 3016 Kansas Avenue, Riverside, Calif. 92507, tel. 909-684-5110, www.luxfercylinders.com). CATALINA® pressure vessels are another manufactured type of light-weight aluminum pressure vessels (CATALINA® is a registered trademark of Aluminum Precision Products, 7300 Anaconda Avenue, Garden Grove, Calif. 92841, tel. 714-890-0999, www.catalinacylinders.com). While both Luxfer and Catalina manufacture pressure vessels, there are dimensional differences between each manufacturer's design. For example, the neck of the Luxfer and Catalina pressure vessels have different lengths. The collar 30, therefore, is sized to allow a single head ring 20 to adapt to either manufacturer's pressure vessel design. For example, the height of the collar 30, corresponding to the length of the neck of a pressure vessel, has a sufficient maximum value so that the head ring 20 may be interchangeably utilized with a plurality of different pressure vessels. Those skilled in the art readily recognize that the base 22, the posts 24, the collar 30, the first ring 34, and the second ring 36 may also be designed to suit any particular pressure vessel application.

Figure 5:
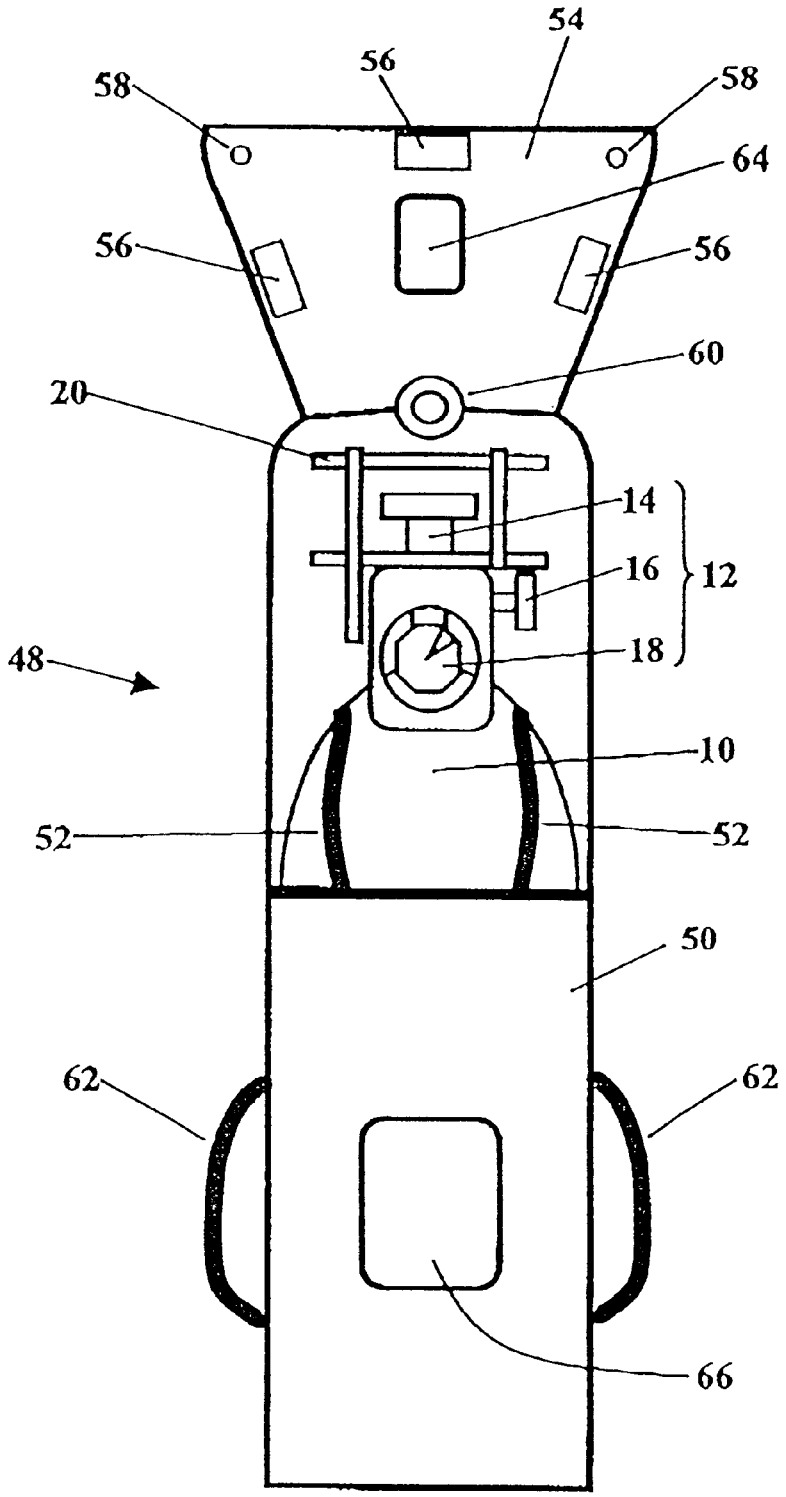
FIG. 5 is a side view of a particular pressure vessel package utilizing the head ring assembly shown in FIGS. 1–4.
Figure 6:
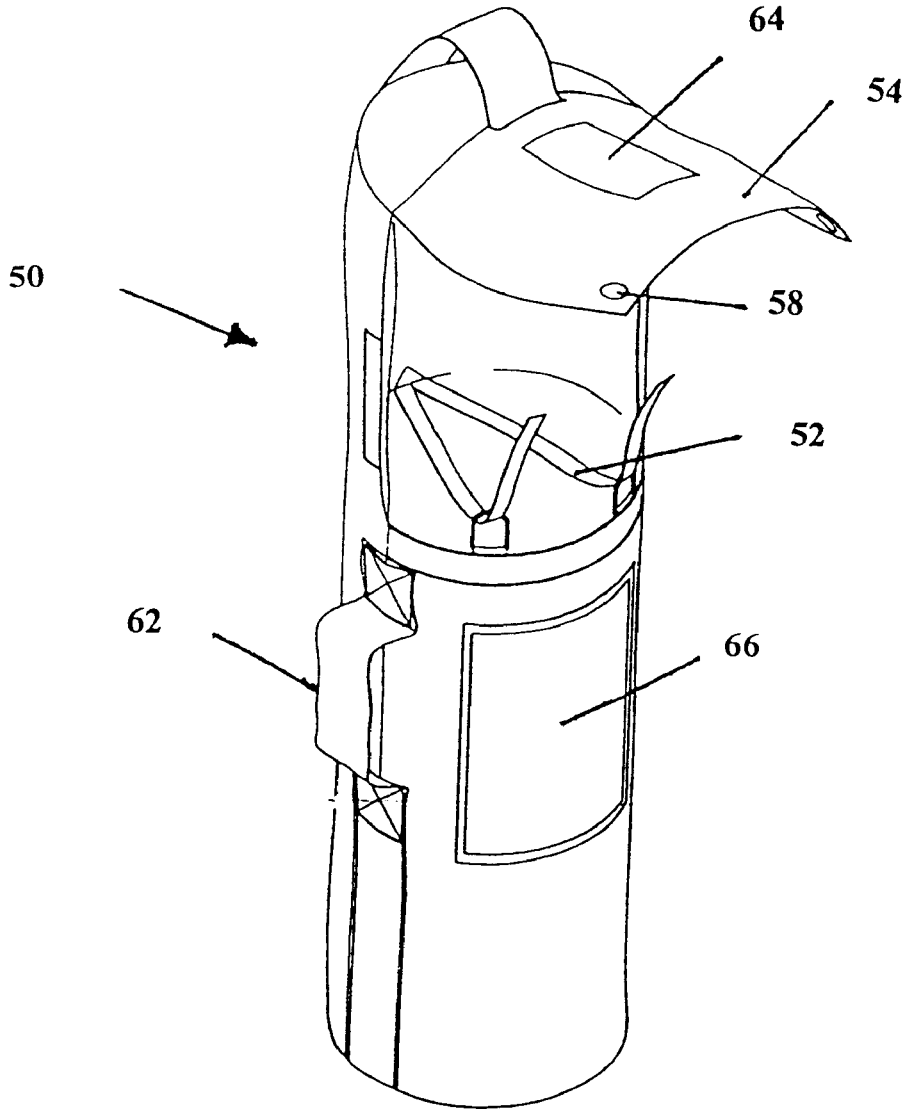
FIG. 6 is a perspective view of an outer pack of the pressure vessel package shown in FIG. 5.

FIG. 5 shows a particular pressure vessel package 48 utilizing the head ring 20 of the present invention. This particular pressure vessel package 48 is designed to comply with the Air Transport Association's Specification 300: Packaging of Airline Supplies ("ATA-300"), and the International Air Transport Association's Specification 200: Packing Instruction ("ATA-200"). This specification establishes the airline industry's requirements for the design, development, and procurement of shipping containers acceptable for air transport. The package 48, shown in FIG. 5, includes the pressure vessel 10, the valving assembly 12, the head ring 20, and an outer pack 50 protecting the valving assembly 12. The outer pack 50, also shown in FIG. 6, represents a bag into which the pressure vessel 10 slides. The outer pack 50 surrounds the pressure vessel 10 and the valving assembly 12. The outer pack 50 is constructed of a flame retardant, flame resistant material. The outer pack 50 has an overall diameter in the range of about 6 inches to about 7 inches and an overall height in the range of about 23 inches to about 25 inches. Vessel straps 52 secure the pressure vessel 10 to the outer pack 50. A flap portion 54 folds over the head ring 20, and the flap portion 54 is retained by hook and loop fasteners 56 and by mechanical fasteners 58. A brass grommet 60 provides a passage for a cannula or mask supply tube to connect with the valving assembly 12. Pack straps 62 allow the package 48 to be easily carried. A first clear vinyl window 64 allows viewing of the regulator 14 and/or the content gauge 18. An outer pocket 66, also having a clear vinyl window, accepts shipping documents or other identifying paperwork. The head ring 20 and the outer pack 50 combine to satisfy the packaging requirements of ATA-300 and IATA-200.

The package 48 is constructed of durable materials. The outer pack 50, flap portion 54, and outer pocket 66 are constructed, for example, from 1000 Denier Dupont Cordura. The vessel straps 52 and the pack straps 62 are made from polypropylene having a tensile strength of 750 lbs. The first clear vinyl window 64 is extruded from sixteen (16) gauge clear vinyl.

Figure 7:
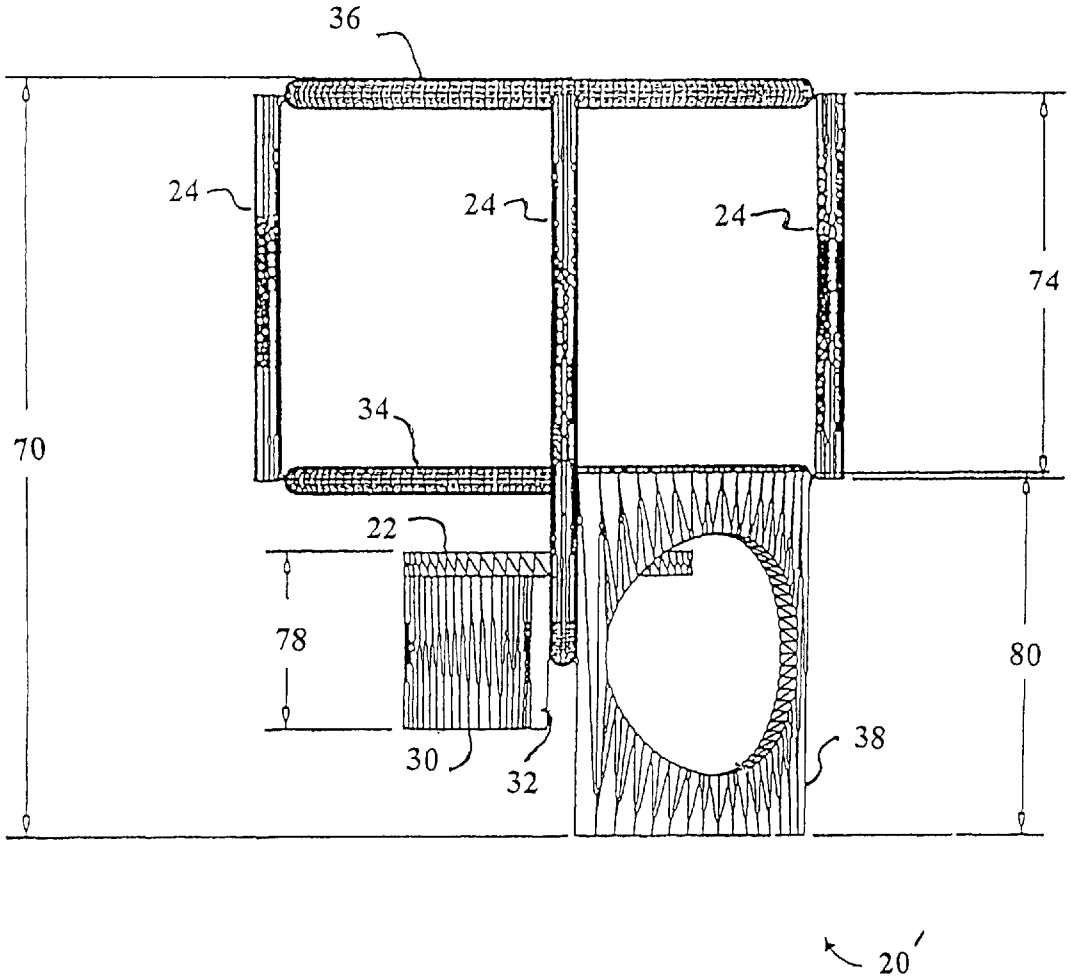
FIGS. 7–9 are, respectively, side, top, and perspective dimensional drawings of the head ring assembly shown in FIGS. 1–5.
Figure 8:
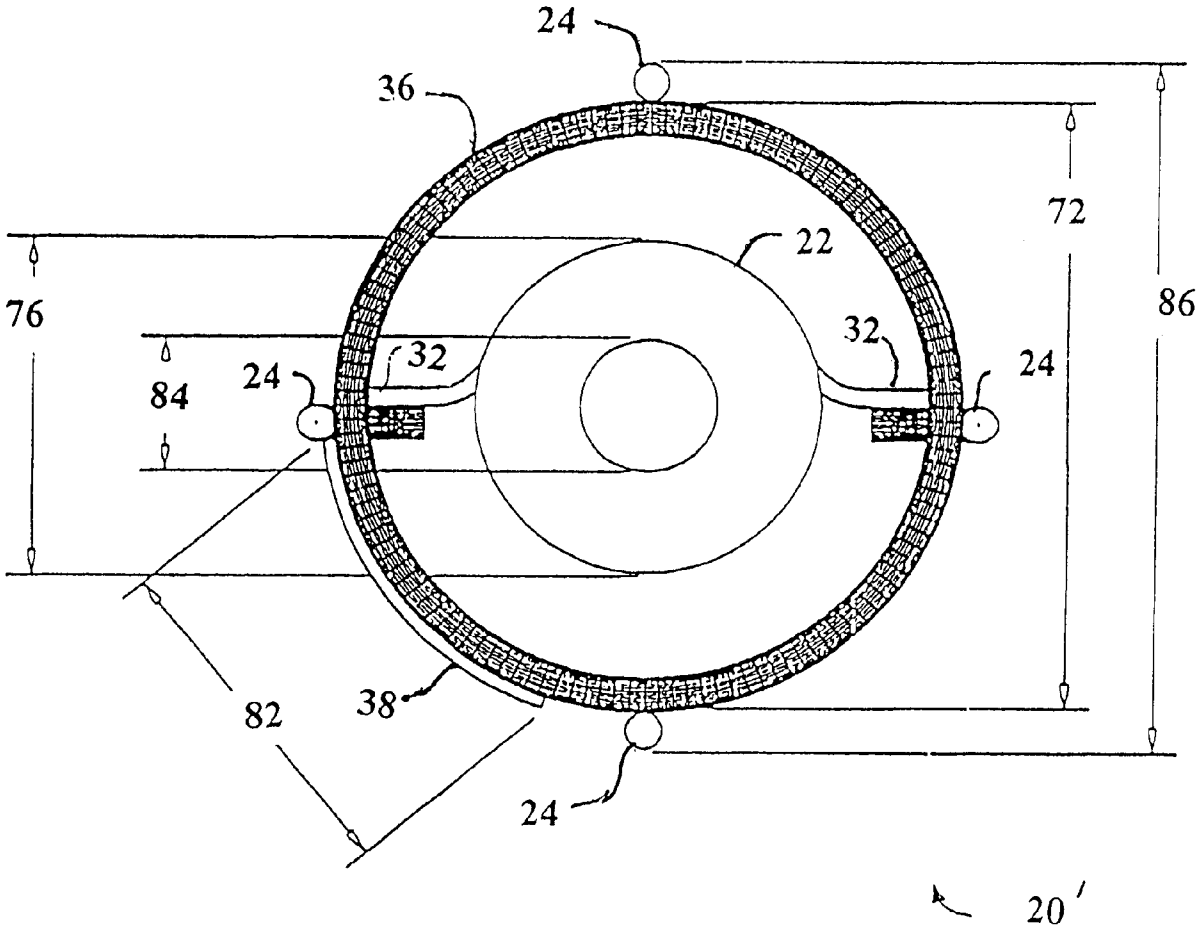
Figure 9:
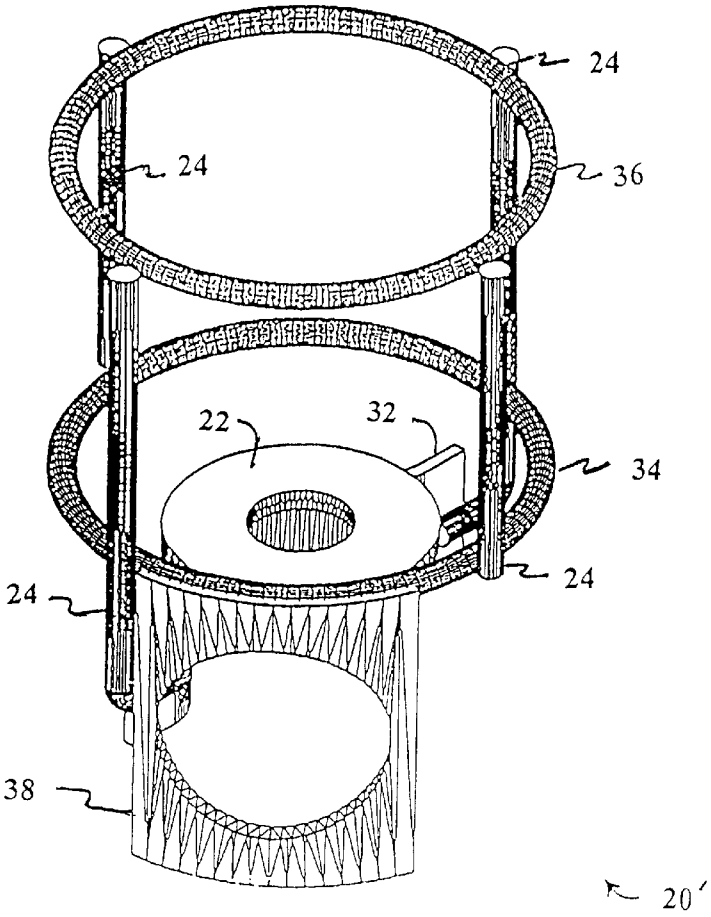

FIGS. 7–9 are, respectively, side, top, and perspective dimensional drawings of the head ring 20.

Figure 10:
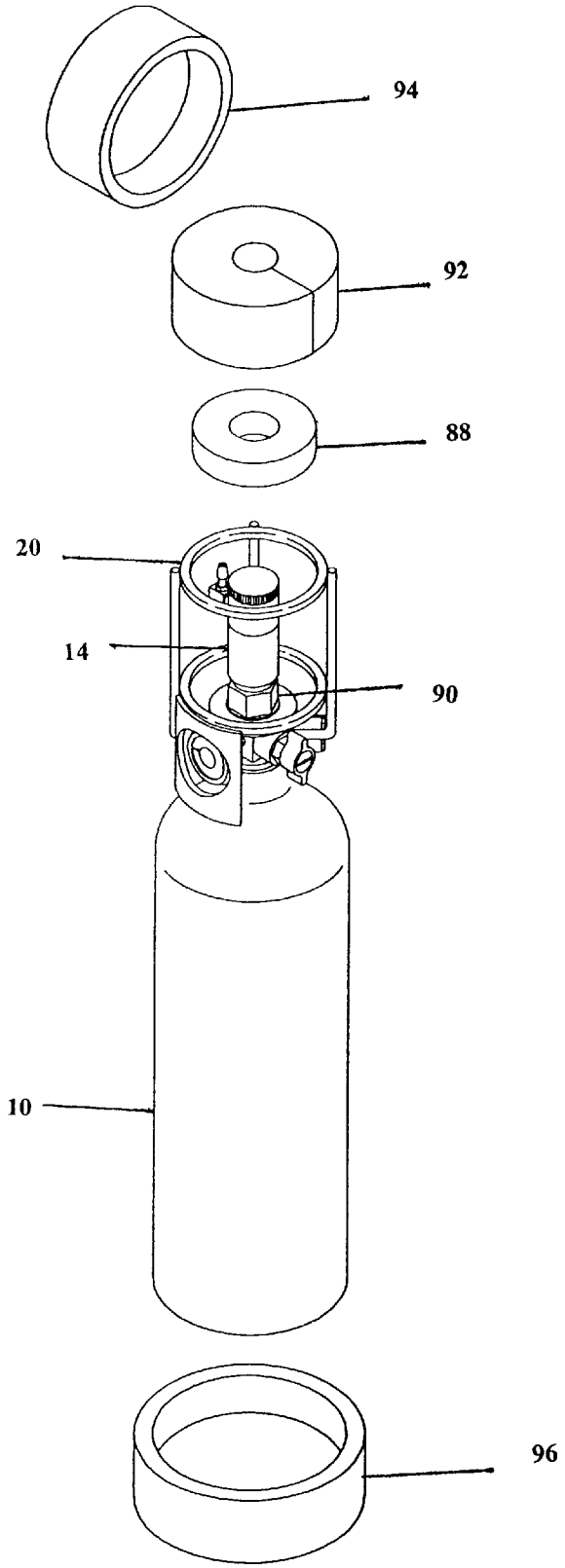
FIG. 10 is an exploded perspective view of a pressure vessel utilizing the head ring assembly of FIGS. 1–5 and 7–9, further utilizing a series of cushioning discs and pads.

Optionally, as shown in FIG. 10, the pressure vessel package 48 (FIG. 5) may also include a plurality of cushioning discs and pads. The plurality of cushioning discs and pads may include a first disc 88 disposed within the head ring assembly 12 and positioned such that it surrounds the nut 90 at the base of the regulator 14. The first disc 88 may be made of, for example, wood or any other suitable cushioning material and protects the regulator 14 from shock and deformation resulting from impact. A second disc 92, made of, for example, PE foam or any other suitable cushioning material, may be disposed within the head ring 12, adjacent to the first disc 88 and surrounding the regulator 14. Additionally, top 94 and bottom 96 boot pads may be positioned such that the top boot pad 94 surrounds the head ring assembly and the bottom boot pad 96 surrounds the bottom of the pressure vessel 10. The top 94 and bottom 96 boot pads may be made of, for example, rubber or any other suitable cushioning material. The top 94 and bottom 96 boot pads protect the head ring assembly 12 and pressure vessel 10 from shock and deformation resulting from impact. Preferably, the top 94 and bottom 96 boot pads are disposed within and fixedly attached to the interior of the outer pack 50 (FIGS. 5 and 6) of the pressure vessel package 48 (FIG. 5).

EXAMPLE

One embodiment of the head ring 20 is further illustrated by the following non-limiting example. This particular non-limiting example of the head ring 20 is sized for oxygen dispensing pressure vessels used in the airline industry. While this example is sized for use in the airline industry, the dimensions given below may vary for other applications. The head ring 20 shown in FIGS. 1–4, and further shown in FIGS. 6–8, has an overall height 70 (FIG. 6) in the range of about 5 inches to about 8 inches, preferably in the range of about 6 inches to about 7 inches, to protect the valving assembly 12. In particular, the head ring 20 protects the regulator 14, which is a compact regulator design such as part number 165408DA produced by Precision Medical, Inc. or part number CP540-8UNBR-SH produced by Contemporary Products, Inc. The first ring 34 and the second ring 36 each have an outer diameter 72 (FIG. 7) in the range of about 3 inches to about 5 inches. The first ring 34 and the second ring 36 have a spacing 74 (FIG. 6) in the range of about 3 inches to about 4 inches. The base 22 has a diameter 76 (FIG. 6) in the range of about 2 inches to about 3 inches, while the collar 30 has a height 78 in the range of about 1 inch to about 2 inches. The gauge protection plate 38 extends downward from the first ring 34. The gauge protection plate 38 has a width 82 (FIG. 7) in the range of about 2 inches to about 3 inches. The base opening 46 has a diameter 84 (FIG. 7) in the range of about ½ inch to about 1½ inches.

The head ring 20 is preferably constructed of welded low carbon steel components. The base 22, the posts 24, the collar 30, the first ring 34, and the second ring 36 are formed from common steel stock and formed to shape. For example, the posts 24, the first ring 34 and the second ring 36 are formed from nominal 0.25-inch diameter hot-rolled steel bar stock, such as A-36 steel having about 36,000 lbs. minimum yield strength, giving the head ring 20 an overall outer diameter 84 (FIG. 7) in the range of about 4 inches to about 5 inches. The diameter of the rings and posts may be in the range of about ⅛ inch to about ½ inch, preferably about ¼ inch. The gauge protection plate 38 is formed from ⅛"×1¼" sections of hot-rolled flat steel, such as the A-36 steel described above. The base 22 may be formed from 2¼" round 1018 cold finish steel. The components preferably are welded together, such as by using 0.030" ER705-6 weld joints. The thickness of the base 22 and the gauge protection plate 38 may be in the range of about 1/16 inch to ¼ inch, and preferably about ⅛ inch. Those skilled in the art will readily recognize the head ring 20 may be constructed from many other materials, including stainless steels, other alloy steels, powder metals, nonferrous metals (aluminum, brass, etc.), composite materials, ceramic materials, polymeric materials, alloys and combinations thereof. The preferred embodiment also includes color coating, such as enamel paint.

While the present invention has been described with respect to various features, aspects, and embodiments, those skilled and unskilled in the art will recognize that the invention is not so limited. Variations, modifications, and alternative embodiments may be made without departing from the spirit and scope of the present invention. Those skilled in the art, for example, readily recognize that the particular example described in this application may be dimensionally altered to suit other design requirements. Those skilled in the art also readily recognize that the particular example may be altered to suit a particular pressure vessel design or configuration. Thus, the head ring 20 may be utilized with any size pressure vessel to protect the valving attached to the pressure vessel.

What is claimed is:

1. A head ring assembly for protecting a valving assembly on a pressure vessel, the head ring assembly comprising:

a base securable to a dispensing end of the pressure vessel;

a plurality of posts equally distributed about the perimeter of the base and extending vertically upward from about the base, each of the plurality of posts having a first end and a second end;

a collar having a plurality of radially-extending flanges, the collar secured to and extending vertically downward from a portion of the base, the first end of at least two opposing posts secured to at least two of the flanges;

a first horizontally-extending ring secured to each of the plurality of posts adjacent to the first ends;

a second horizontally-extending ring secured to each of the plurality of posts adjacent to the second ends; and a gauge protection plate extending vertically downward from a portion of the perimeter of the first ring, the gauge protection plate having an interior wall defining an opening sized to allow visual access to a content gauge.

2. The head ring assembly of claim 1, wherein the base further comprises an interior wall defining a base opening sized to allow passage of a portion of a flow adjuster through the base opening.

3. The head ring assembly of claim 1, wherein the plurality of posts comprises four or more posts.

4. The head ring assembly of claim 1, wherein the collar is supportable against a necked end of the pressure vessel for providing additional stability to the head ring assembly.

5. The head ring assembly of claim 1, wherein the collar and the plurality of flanges are integrally formed.

6. The head ring assembly of claim 1, further comprising attachments for securing the base, posts, collar, rings, and gauge protection plate, the attachments having sufficient strength for withstanding the forces of a dropped or toppled pressure vessel.

7. The head ring assembly of claim 1, wherein the head ring assembly is sized to protect the valving assembly of more than one size or configuration of pressure vessel.

8. A head ring assembly for protecting a regulator, a flow adjuster, and a content gauge on a pressure vessel of more than one size or configuration, the head ring assembly comprising:

a base secured to a regulator end of the pressure vessel, wherein a threaded portion of the flow adjuster passes through a base opening, the base secured to the regulator end of the pressure vessel when the regulator is threaded onto the flow adjuster;

four or more posts equally distributed about the perimeter of the base and extending vertically upward from about the base to beyond the regulator, each of the posts having a first end and a second end;

a collar having a plurality of radially-extending flanges, the collar secured to and extending vertically downward from a portion of the base mating with a neck of the pressure vessel for providing additional stability to the head ring assembly, the first end of at least two opposing posts secured to at least two of the flanges;

a first horizontally-extending ring secured to each of the posts adjacent to the first ends, the first ring radially positioned outward of the regulator, the flow adjuster, and the content gauge;

a second horizontally-extending ring secured to each of the posts adjacent to the second ends, the second ring radially positioned outward of the regulator, the flow adjuster, and the content gauge;

a gauge protection plate extending vertically downward from a portion of the perimeter of the first ring, the gauge protection plate having an interior wall defining an opening sized to allow visual access to the content gauge; and attachments for securing the base, posts, collar, rings, and gauge protection plate, the attachments having sufficient strength for withstanding the forces of a dropped or toppled pressure vessel.

9. The head ring assembly of claim 8, wherein the first and second horizontally extending rings have an outer diameter in the range of 3 inches to 5 inches.

10. The head ring assembly of claim 8, wherein the four or more posts have a height in the range of 4 inches to 6 inches.

11. The head ring assembly of claim 8, wherein the base has an inner diameter in the range of ½ inch to 1½ inches.

12. A package assembly for protecting a pressure vessel having a valving assembly, the package assembly comprising:

a head ring assembly, comprising:

a base securable to a dispensing end of the pressure vessel;

a plurality of posts distributed about the perimeter of the base and extending vertically upward from about the base, each of the plurality of posts having a first end and a second end;

a collar having a plurality of radially-extending flanges, the collar secured to and extending vertically downward from a portion of the base, the first end of at least two opposing posts secured to at least two of the flanges;

a plurality of horizontally-extending rings secured to each of the plurality of posts adjacent to the first and/or second ends;

a gauge protection plate extending vertically downward from a portion of the perimeter of a first ring, the gauge protection plate having an interior wall defining an opening sized to allow visual access to a content gauge; and an outer pack defining a bag sized to surround the pressure vessel, the valving assembly, and the head ring assembly, the outer pack comprising a durable material.

13. The package assembly of claim 12, further comprising a pressure vessel having a dispensing end with the valving assembly secured to the dispensing end, the valving assembly including at least one component selected from the group consisting of a regulator, a flow adjuster, and the content gauge.

14. The package assembly of claim 12, wherein the outer pack comprises a bag made of a flame resistant material.

15. The package assembly of claim 12, further comprising one or more straps, wherein the outer pack is secured to the pressure vessel with the one or more straps.

16. The package assembly of claim 12, wherein the outer pack further comprises a flap portion that folds over the head ring assembly.

17. The package assembly of claim 12, wherein the outer pack further comprises a clear window.

* * * * *